US011417944B2

(12) United States Patent
Wan et al.

(10) Patent No.: US 11,417,944 B2
(45) Date of Patent: Aug. 16, 2022

(54) ANTENNA ASSEMBLY AND BASE STATION ANTENNA INCLUDING THE ANTENNA ASSEMBLY

(71) Applicant: CommScope Technologies LLC, Hickory, NC (US)

(72) Inventors: Fangwen Wan, Suzhou (CN); Hangsheng Wen, Suzhou (CN); Yuemin Li, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 62 days.

(21) Appl. No.: 17/170,085

(22) Filed: Feb. 8, 2021

(65) Prior Publication Data

US 2021/0257720 A1 Aug. 19, 2021

(30) Foreign Application Priority Data

Feb. 13, 2020 (CN) ..... 202010089787.9

(51) Int. Cl.
*H01Q 1/24* (2006.01)
*H01Q 21/06* (2006.01)
(Continued)

(52) U.S. Cl.
CPC ..... *H01Q 1/246* (2013.01); *H01Q 9/045* (2013.01); *H01Q 21/068* (2013.01); *H01Q 21/22* (2013.01); *H01Q 21/26* (2013.01)

(58) Field of Classification Search
CPC .. H01Q 1/246; H01Q 21/0006; H01Q 21/062; H01Q 1/521; H01Q 19/10; H01Q 21/22; H01Q 5/48; H01Q 9/045; H01Q 1/523; H01Q 15/14; H01Q 19/108; H01Q 21/0025; H01Q 21/061; H01Q 25/00;
(Continued)

(56) References Cited

U.S. PATENT DOCUMENTS 6,943,732 B2 9/2005 Goettl et al.
6,985,123 B2 * 1/2006 Gottl ..... H01Q 21/24 343/795
(Continued)

FOREIGN PATENT DOCUMENTS

CA 1226936 A 9/1987
CN 105849976 A 8/2016
(Continued)

*Primary Examiner* — Vibol Tan
(74) *Attorney, Agent, or Firm* — Myers Bigel, P.A.

(57) ABSTRACT

An antenna assembly includes a first interface for receiving a first RF signal, a second interface for receiving a second RF signal, and an antenna array including a first array and a second array that extend vertically. The first array includes a first radiating element and a second radiating element, and the second array includes a third radiating element and a fourth radiating element. A power coupling circuit is provided, which is configured to feed a first sub-component of the first RF signal and a first sub-component of the second RF signal to the first radiating element and/or the third radiating element in a power-reduced coupling manner. A plurality of radiating elements in the first array are electrically connected to the first interface, and a plurality of radiating elements in the second array are electrically connected to the second interface, respectively.

30 Claims, 11 Drawing Sheets

(51) Int. Cl.
*H01Q 9/04* (2006.01)
*H01Q 21/26* (2006.01)
*H01Q 21/22* (2006.01)

(58) Field of Classification Search
CPC .. H01Q 3/36; H01Q 3/40; H01Q 5/30; H01Q 9/285; H01Q 5/321; H01Q 21/065; H01Q 21/068; H01Q 21/26; H01Q 1/50
See application file for complete search history.

(56) References Cited

U.S. PATENT DOCUMENTS

| | | | | |
|---|---|---|---|---|
| 7,050,005 | B2 | 5/2006 | Goettl et al. | |
| 8,416,142 | B2 * | 4/2013 | Gottl | H01Q 5/48 343/893 |
| 9,438,278 | B2 * | 9/2016 | Barker | H04B 1/0053 |
| 9,444,151 | B2 | 9/2016 | Kurk et al. | |
| 10,411,350 | B2 * | 9/2019 | Thalakotuna | H01Q 1/523 |
| 10,840,607 | B2 * | 11/2020 | Mei | H01P 5/18 |
| 2004/0051677 | A1 | 3/2004 | Goettl | |
| 2009/0179814 | A1 | 7/2009 | Park et al. | |
| 2009/0278759 | A1 | 11/2009 | Moon et al. | |
| 2011/0148730 | A1 | 6/2011 | Maximilian | |
| 2013/0271336 | A1 | 10/2013 | Plet et al. | |
| 2014/0225792 | A1 | 8/2014 | Lee et al. | |
| 2015/0222015 | A1 | 8/2015 | Thalakotuna et al. | |
| 2018/0375220 | A1 * | 12/2018 | Mei | H01Q 21/0006 |
| 2019/0273315 | A1 | 9/2019 | Hu et al. | |
| 2020/0358190 | A1 | 11/2020 | Chen et al. | |

FOREIGN PATENT DOCUMENTS

| | | | |
|---|---|---|---|
| CN | 106711622 | A | 5/2017 |
| CN | 206461086 | U | 9/2017 |
| EP | 0163997 | A2 | 12/1985 |
| EP | 0325012 | A1 | 7/1989 |
| JP | 2004241972 | A | 8/2004 |
| KR | 101720485 | B1 | 3/2017 |
| WO | 9936992 | A2 | 7/1999 |
| WO | 2010063007 | A2 | 6/2010 |
| WO | 2015082000 | A1 | 6/2015 |

* cited by examiner

ANTENNA ASSEMBLY AND BASE STATION ANTENNA INCLUDING THE ANTENNA ASSEMBLY

REFERENCE TO PRIORITY APPLICATION

The present application claims the benefit under 35 USC 119(a) to Chinese Patent Application No. 202010089787.9, filed Feb. 13, 2020, the disclosure of which is hereby incorporated herein by reference

TECHNICAL FIELD

The present invention relates to the field of radio communications, and, more particularly, to an antenna assembly and a base station antenna including this antenna assembly.

BACKGROUND ART

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station.

In many cases, each base station is divided into "sectors." In perhaps the most common configuration, a hexagonally shaped cell is divided into three 120° sectors, and each sector is served by one or more base station antennas that have an azimuth Half Power Beam width (HPBW) of approximately 65°. Typically, the base station antennas are mounted on a tower structure, with the radiation patterns (also referred to herein as "antenna beams") that are generated by the base station antennas directed outwardly. Base station antennas are often implemented as linear or planar phased arrays of radiating elements.

In order to accommodate the ever-increasing volumes of cellular communications, cellular operators have added cellular services in a variety of new frequency bands. While in some cases it is possible to use linear arrays of so-called "wide-band" or "ultra wide-band" radiating elements to provide service in multiple frequency bands, in other cases it is necessary to use different linear arrays (or planar arrays) of radiating elements to support service in the different frequency bands.

As the number of frequency bands has proliferated, increased sectorization has become more common (e.g., dividing a cell into six, nine or even twelve sectors) and the number of base station antennas deployed at a typical base station has increased significantly. However, due to local zoning ordinances and/or weight and wind loading constraints for the antenna towers, etc. there is often a limit as to the number of base station antennas that can be deployed at a given base station. In order to increase capacity without further increasing the number of base station antennas, so-called multi-band base station antennas have been introduced in which multiple linear arrays of radiating elements are included in a single antenna. One very common multi-band base station antenna design includes one linear array of "low-band" radiating elements that are used to provide service in some or all of the 617-960 MHz frequency band, and two linear arrays of "high-band" radiating elements that are used to provide service in some or all of the 1427-2690 MHz frequency band. These linear arrays of low-band radiating elements and high-band radiating elements are typically mounted in side-by-side fashion.

There is also significant interest in the following base station antennas, which can include two linear arrays of low-band radiating elements and two (or four) linear arrays of high-band radiating elements. These antennas may be used in a variety of applications including 4×4 multi-input-multi-output ("MIMO") applications or as multi-band antennas having two different low-bands (e.g., a 700 MHz low-band linear array and an 800 MHz low-band linear array) and two different high-bands (e.g., an 1800 MHz high-band linear array and a 2100 MHz high-band linear array). Such antennas, however, are challenging to implement in a commercially acceptable manner because achieving an approximately 65° azimuth HPBW antenna beam in the low-band typically requires low-band radiating elements that are at least 200 mm wide. But, when two arrays of low-band radiating elements are placed side-by-side with high-band linear arrays therebetween, a base station antenna having a width D (along a direction H in FIG. 1) of about 500 mm may be required. Such large antennas may have very high wind loading, may be very heavy, and/or may be expensive to manufacture. Operators would prefer base station antennas having widths D of about 430 mm or less than 430 mm (for example, 400 mm, 380 mm).

SUMMARY

An object of the present invention is to provide an antenna assembly and a base station antenna including this antenna assembly, in which the antenna assembly can achieve a narrow HPBW and a high antenna gain.

According to a first aspect of the present invention, there is provided an antenna assembly. The antenna assembly includes a first interface for receiving a first RF signal and a second interface for receiving a second RF signal. An antenna array is also provided. The antenna array includes a first array and a second array, which extend vertically. A plurality of radiating elements in the first array are electrically connected to the first interface, and a plurality of radiating elements in the second array are electrically connected to the second interface. The first array includes a first radiating element and a second radiating element, and the second array includes a third radiating element and a fourth radiating element. The second radiating element is electrically connected to the second interface, and/or the fourth radiating element is electrically connected to the first interface. A power coupling circuit is provided, which is configured to feed a first sub-component of the first RF signal and a first sub-component of the second RF signal to the first radiating element and/or the third radiating element in a power-reduced coupling manner.

In some embodiments, the second radiating element and the fourth radiating element are electrically connected to either of the first interface and the second interface, respectively. In some other embodiments, the second radiating element and the fourth radiating element are electrically connected not only to the first interface but also to the second interface. In some further embodiments, the power coupling circuit includes a first input end, a second input end, a first output end, and a second output end. The first input end is electrically connected to the first interface for receiving the first sub-component (S1) of the first RF signal, the second input end is electrically connected to the second interface for receiving the first sub-component (S2) of the second RF signal, the first output end is electrically connected to the first radiating element for feeding a first output signal (S1*) to the first radiating element, and the second output end is electrically connected to the third radiating element for feeding a second output signal (S2*) to the third radiating element.

In some of these embodiments, the first output signal (S1*) is generated from the first sub-component (S1) of the first RF signal and the first sub-component (S2) of the second RF signal in a power-reduced coupling manner as follows: $S1^*=(k1)S1+(k2)S2$, where k1 is a first power conversion coefficient, k2 is a second power conversion coefficient, and $0.7 \leq k1 \leq 0.90$; $0.005 \leq k2 \leq 0.025$. In addition, the second output signal (S2*) is generated from the first sub-component (S2) of the second RF signal and the first sub-component (S1) of the first RF signal in a power-reduced coupling manner as follows: $S2^*=(k3)S2+(k4)S1$, where k3 is a third power conversion coefficient, k4 is a fourth power conversion coefficient, and $0.7 \leq k3 \leq 0.90$; $0.0026 \leq k4 \leq 0.027$.

In some additional embodiments, the antenna assembly includes a reflector, on which the antenna array is mounted. This reflector may have a width that is not larger than 430 mm. In addition, the first array may include one or more fifth radiating elements, which are electrically connected to the first interface, and/or the second array may include one or more sixth radiating elements, which are electrically connected to the second interface. The first radiating element and the third radiating element may be adjacent each other in a horizontal direction. Also, the first radiating element may be disposed in a middle region of the first array, and the third radiating element may be disposed in a middle region of the second array. Similarly, the second radiating element and the fourth radiating element may be adjacent each other in a horizontal direction. In some further embodiments, the second radiating element is disposed in an end region of the first array, and the fourth radiating element is disposed in an end region of the second array. According to additional embodiments, only one power coupling circuit is provided for the first array and the second array.

In some further embodiments, the first sub-component of the first RF signal occupies the largest share of the first RF signal, and/or the first sub-component of the second RF signal occupies the largest share of the second RF signal. A plurality of radiating elements in the first array and the fourth radiating element in the second array form an L-shaped topology, and/or a plurality of radiating elements in the second array and the second radiating element in the first array form an L-shaped topology. The antenna assembly may also include power distribution networks and/or phase shift networks, and the first interface and the second interface may be electrically connected to corresponding radiating elements via the power distribution networks and/or the phase shift networks, respectively.

According to another embodiment of the invention, there is provided an antenna assembly, which includes a first interface for receiving a first RF signal and a second interface for receiving a second RF signal. A reflector is provided with an antenna array mounted thereon. The antenna array includes a first array and a second array that extend vertically. A plurality of radiating elements in the first array are electrically connected to the first interface, and a plurality of radiating elements in the second array are electrically connected to the second interface. The first array includes a first radiating element and a second radiating element, whereas the second array includes a third radiating element and a fourth radiating element. The second radiating element is electrically connected to the second interface, and/or the fourth radiating element is electrically connected to the first interface. According to these embodiments, only one power coupling circuit is provided for the first array and the second array. This power coupling circuit is configured to feed a first sub-component of the first RF signal and a first sub-component of the second RF signal to the first radiating element and/or the third radiating element in a power-reduced coupling manner.

In some other embodiments, only one second radiating element in the first array is electrically connected to the second interface, and/or only one fourth radiating element in the second array is electrically connected to the first interface. The first radiating element and the third radiating element may extend adjacent each other in a horizontal direction. The first radiating element may be disposed in a middle region of the first array, and the third radiating element may be disposed in a middle region of the second array. The second radiating element and the fourth radiating element may also extend adjacent each other in a horizontal direction.

In some further embodiments, the second radiating element is disposed in an end region of the first array, and the fourth radiating element is disposed in an end region of the second array. The first sub-component of the first RF signal may occupy the largest share of the first RF signal, and/or the first sub-component of the second RF signal may occupy the largest share of the second RF signal. In some further embodiments, a plurality of radiating elements in the first array and the fourth radiating element in the second array form an L-shaped topology, and/or a plurality of radiating elements in the second array and the second radiating element in the first array form an L-shaped topology. The reflector may have a width not larger than 430 mm, 400 mm, 380 mm, 360 mm or 300 mm, for example.

According to still further embodiments of the invention, an antenna assembly is provided that includes a first interface for receiving a first RF signal and a second interface for receiving a second RF signal. An antenna array is provided, which includes a first array and a second array that extend vertically. A plurality of radiating elements in the first array are electrically connected to the first interface, and a plurality of radiating elements in the second array are electrically connected to the second interface. The first array includes a first radiating element, and the second array includes a third radiating element. A power coupling circuit is provided, which is configured to feed a first sub-component of the first RF signal and a first sub-component of the second RF signal to the first radiating element in the first array and/or the third radiating element in a power-reduced coupling manner. The antenna array further includes a seventh radiating element, which is provided in staggered arrangement from the first array and the second array in a horizontal direction. The seventh radiating element is electrically connected to both the first interface and the second interface. The first radiating element and the third radiating element may extend adjacent to each other in the horizontal direction. The first radiating element is disposed in a middle region of the first array, and the third radiating element is disposed in a middle region of the second array. The seventh radiating element may also be disposed between the first array and the second array in the horizontal direction. In addition, the first sub-component of the first RF signal occupies the largest share of the first RF signal, and/or the first sub-component of the second RF signal occupies the largest share of the second RF signal. A base station antenna may also be provided, which includes an antenna assembly as described herein.

BRIEF DESCRIPTION OF THE DRAWINGS

The present invention will be explained in more detail below by specific embodiments with reference to the accompanying drawings. The schematic drawings are briefly described as follows.

DESCRIPTION OF EMBODIMENTS

Figure 1:
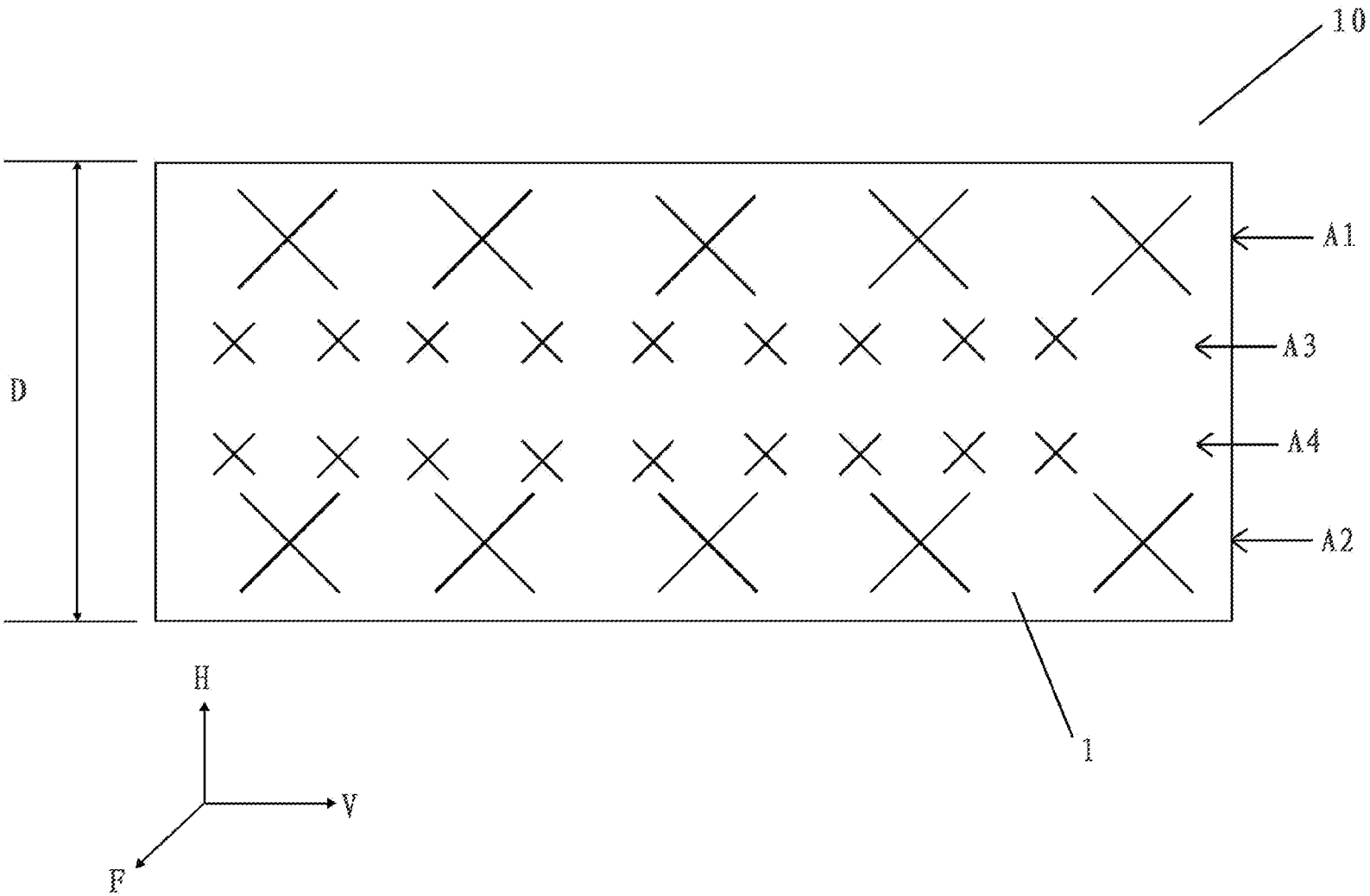
FIG. 1 is a schematic front view of an antenna assembly in accordance with some embodiments of the present invention.

The present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the protection scope of the present invention to a person skilled in the art. It should also be understood that the embodiments disclosed herein can be combined in various ways to provide many additional embodiments.

It should be understood that in all the drawings, the same reference signs present the same elements. In the drawings, for the sake of clarity, the sizes of certain features may be modified.

It should be understood that the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an", "said" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the relevant items listed. The phases "between X and Y" and "between about X and Y" as used in the specification should be construed as including X and Y. As used herein, phrases such as "between about X and Y" mean "between about X and about Y". As used herein, phrases such as "from about X to Y" mean "from about X to about Y."

In the specification, when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being "directly on", "directly attached" to, "directly connected" to, "directly coupled" with or "directly contacting" another element, there are no intervening elements present. In the specification, references to a feature that is disposed "adjacent" another feature may have portions that overlap, overlie or underlie the adjacent feature.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

The antenna assembly according to embodiments of the present invention are applicable to various types of base station antennas, for example, may be suitable for multi-band base station antennas or MIMO antennas. Embodiments of the present invention will now be described in more detail with reference to the accompanying drawings.

As shown in FIG. 1, the antenna assembly 10 includes a reflector 1 and a plurality of radiating elements mounted on the reflector 1. The reflector may be used as a ground plane structure for the radiating elements. The radiating elements are mounted to extend forwardly (in a forward direction F) from the reflector 1. The radiating elements may include low-band radiating elements and high-band radiating elements, and the low-band radiating elements extend farther forward than the high-band radiating elements. The low-band radiating elements may be configured to transmit and receive radio frequency (RF) signals in a first frequency band such as, for example, the 617-960 MHz frequency range or a portion thereof. The high-band radiating elements may be configured to transmit and receive RF signals in a second frequency band such as, for example, the 1427-2690 MHz frequency range or a portion thereof.

In the embodiment shown in FIG. 1, the low-band radiating elements indicated by large crosses may be mounted in two vertical columns A1 and A2 to form two vertically-extending linear arrays of low-band radiating elements. The high-band radiating elements indicated by small crosses may also be mounted in two vertical columns A3 and A4 to form two vertically-extending linear arrays of high-band radiating elements. In other embodiments, more than two linear arrays of the low-band radiating elements and/or the high-band radiating elements may be provided.

For the sake of clarity, the high-band radiating elements in FIG. 1, that is, the arrays A3 and A4, are not shown in the following figures, and in order to avoid repeated description, the technical content described hereafter may also be applicable to linear arrays of high-band radiating elements and/or radiating elements of other band type within the scope understood by those skilled in the art.

Figure 2:
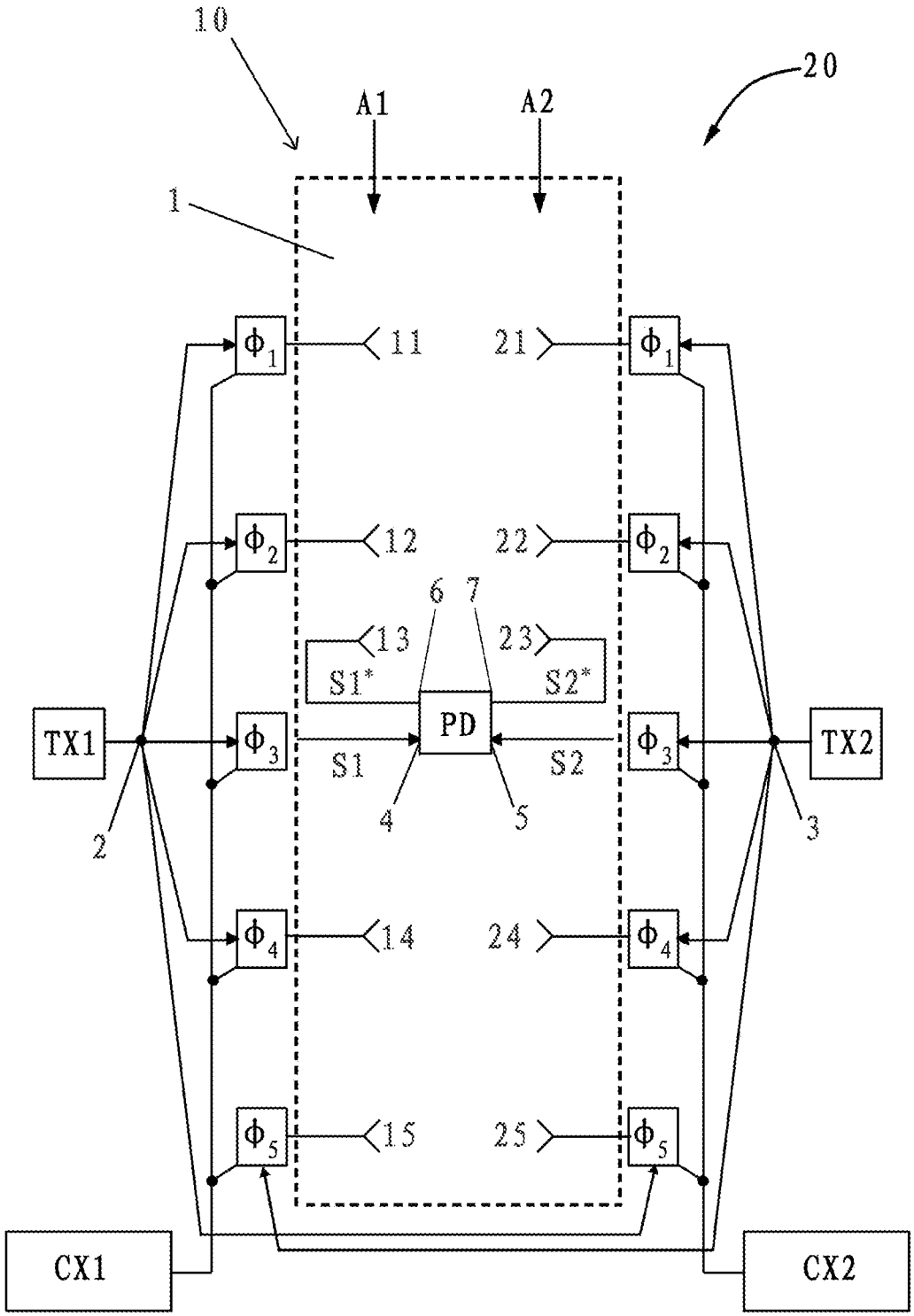
FIG. 2 is a schematic circuit block diagram of a base station antenna including an antenna assembly according to a first embodiment of the present invention.
Figure 4:
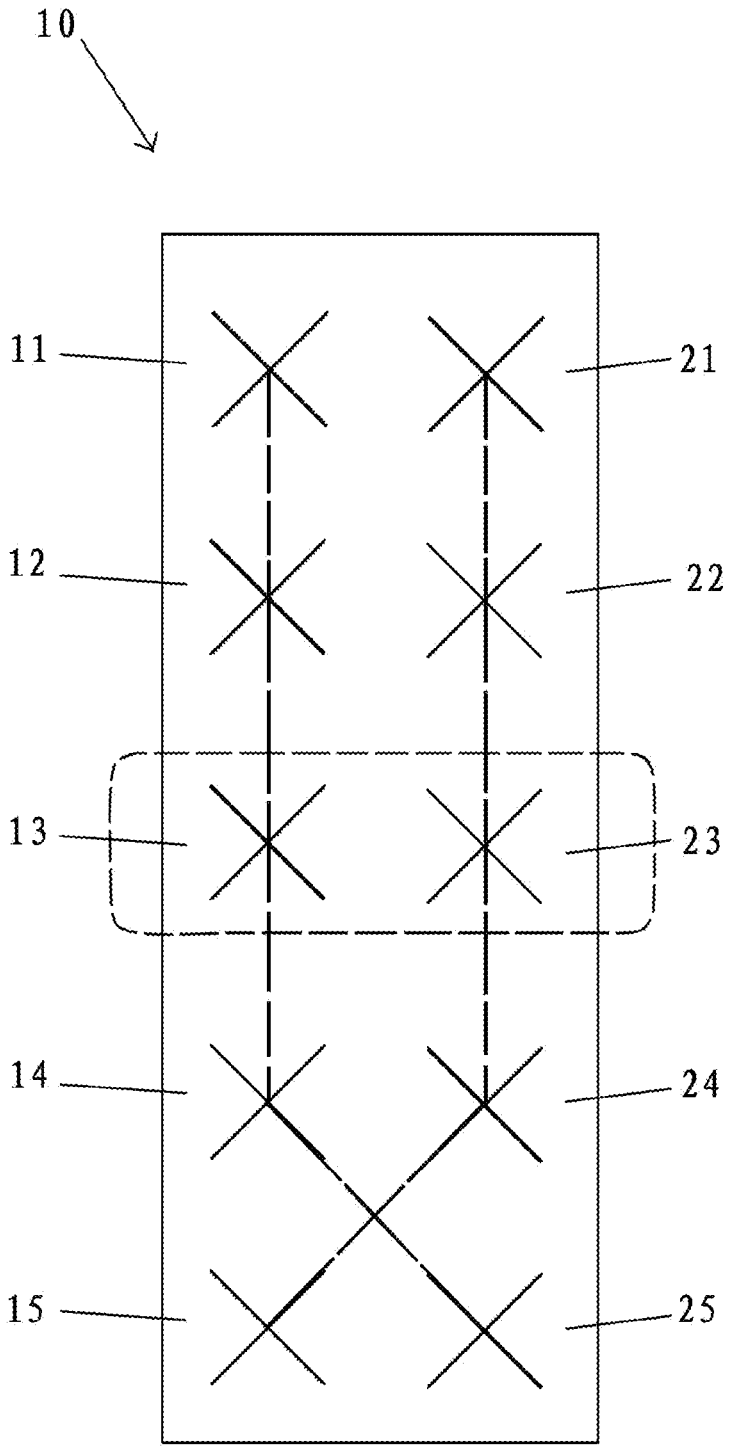
FIG. 4 is a simplified schematic view of the antenna assembly of FIG. 2.

FIG. 2 is a schematic circuit block diagram of a base station antenna including an antenna assembly according to a first embodiment of the present invention, and correspondingly, FIG. 4 is a simplified schematic view of the antenna assembly 10 of FIG. 2.

As shown in FIG. 2, a transmitter TX is configured to generate an RF signal and feed it to the radiating elements in the antenna assembly 10. The transmitter TX may be an RF signal transmitting device inside a base station antenna, or may be an RF signal transmitting device (for example, an RRU) outside the base station antenna. The transmitter TX may include a first transmitter TX1 configured to generate a first RF signal, and a second transmitter TX2 configured to generate a second RF signal. Correspondingly, the antenna assembly 10 may have a first interface 2 and a second interface 3. The first interface 2 may be electrically connected to the first transmitter TX1, for example, via a coaxial cable, for receiving the first RF signal from the first transmitter TX1. The first RF signal is transmitted from the first interface 2 to power distribution networks and/or phase shift networks φ1-φ5 in the downstream side, and the phase shift networks may be controlled by control circuits CX1-CX2. The first RF signal received is then divided into a plurality of sub-components in the power distribution networks and/or the phase shift networks, wherein some or all of the sub-components may be subjected to phase-shifting in the phase shift networks. The plurality of sub-components are transmitted to corresponding radiating elements downstream of the power distribution networks and/or phase shift networks respectively. Likewise, the second interface 3 may be electrically connected to the second transmitter TX2, for example, via a coaxial cable, for receiving the second RF signal from the second transmitter TX2. The second RF signal is transmitted from the second interface 3 to power distribution networks and/or phase shift networks in the downstream side. The second RF signal received may be divided into a plurality of sub-components in the power distribution networks and/or phase shift networks, wherein some or all of the sub-components may be subjected to phase-shifting in the phase shift networks. The plurality of sub-components are transmitted to corresponding radiating elements downstream of the power distribution networks and/or phase shift networks respectively.

It should be understood that the antenna assembly 10 may have any number of interfaces. In some embodiments, the antenna assembly 10 may have only one interface for electrical connection with the corresponding transmitter. In some embodiments, the antenna assembly 10 may have more than two interfaces, for example, in MIMO antennas.

It should be understood that the terms "electrical connection" or "electrically connected", as used herein, may refer to either a direct electrical connection, or an indirect electrical connection. In the case of an indirect electrical connection, an intermediate circuit such as a power distribution network, a phase shift network, a filter circuit and/or other RF signal processing circuits, is connected therebetween.

As shown in FIG. 2, the antenna assembly 10 may include antenna arrays A1 and A2, a power coupling circuit PD assigned to the antenna arrays A1 and A2, and power distribution networks and/or phase shift networks. The antenna arrays include a first array A1 and a second array A2 that extend vertically, that is, extend along a direction V in FIG. 1. The first array A1 and the second array A2 may operate in the same or different frequency bands to provide separate antenna beams. The first array A1 and the second array A2 may each include any number of radiating elements. In FIGS. 2 and 4, the two arrays A1 and A2 may each include five radiating elements by way of example.

Referring to FIGS. 2 and 4, the first array A1 includes a first radiating element 13, and the second array A2 includes a third radiating element 23. The power coupling circuit PD may be assigned to the first radiating element 13 and the third radiating element 23. The power coupling circuit PD may be configured to feed the first sub-component of the first RF signal and the first sub-component of the second RF signal to the first radiating element 13 and/or the third radiating element 23 in a power-reduced coupling manner. With the power coupling circuit PD, the first radiating element 13 is not only electrically connected to the first interface 2 and hence receives a portion of the first sub-component of the first RF signal, but also is electrically connected to the second interface 3 and thus receives a portion of the first sub-component of the second RF signal. Likewise, the third radiating element 23 is not only electrically connected to the second interface 3 and thus receives a portion of the first sub-component of the second RF signal, but also is electrically connected to the first interface 2 and thus receives a portion of the first sub-component of the first RF signal.

Figure 3:
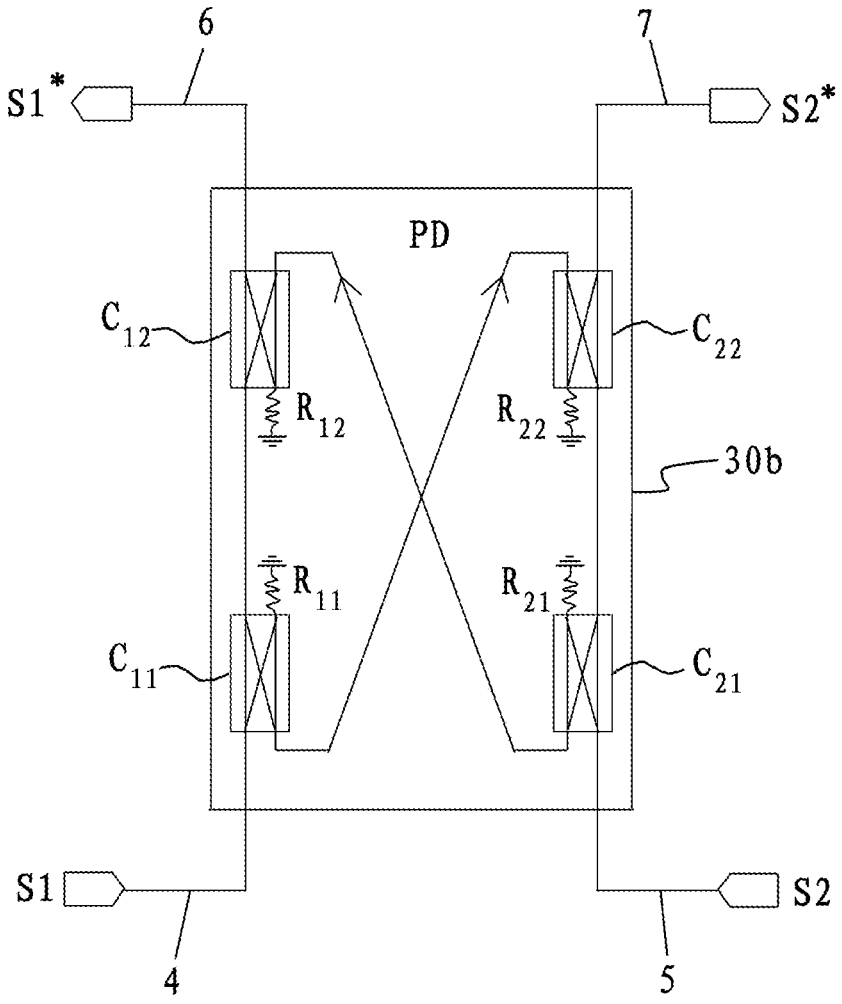
FIG. 3 is a schematic view of a power coupling circuit of the antenna assembly of FIG. 2.

As shown in FIGS. 2 and 3, the power coupling circuit PD may include a first input end 4, a second input end 5, a first output end 6 and a second output end 7. The first input end 4 may be electrically connected to the first interface 2 via a corresponding power distribution network and/or phase shift network and thus receives the first sub-component of the first RF signal as a first input signal S1. The second input end 5 may be electrically connected to the second interface 3 via a corresponding power distribution network and/or phase shift network and thus receives a first sub-component of the second RF signal as a second input signal S2. The first output end 6 may be electrically connected to the first radiating element 13 and thus transmits a first output signal S1* to the first radiating element 13. The second output end 7 may be electrically connected to the third radiating element 23 and thus transmits the second output signal S2* to the third radiating element 23. Correspondingly, the first output signal S1* may be generated from the first input signal S1 and the second input signal S2 in a power-reduced coupling manner as follows: $S1^*=(k1)S1+(k2)S2$, where k1 is a first power conversion coefficient, k2 is a second power conversion coefficient, and $0.7 \le k1 \le 0.90$, $0.005 \le k2 \le 0.025$. Likewise, the second output signal S2* may be generated from the second input signal S2 and the first input signal S1 in a power-reduced coupling manner as follows: $S2^*=(k3)S2+(k4)S1$, where k3 is a third power conversion coefficient, k4 is a fourth power conversion coefficient, and $0.7 \le k3 \le 0.90$, $0.0026 \le k4 \le 0.027$.

FIG. 3 is a schematic view of a power coupling circuit PD of the antenna assembly 10 of FIG. 2 according to an embodiment of the present application. As shown in FIG. 3, the power coupling circuit PD includes two pairs of 4-port cascaded directional couplers ((C11-C12), (C21-C22)), which may be cross-coupled, with single-port resistor termination via R11, R12, R21, R22, to thereby convert the first input signal S1 and the second input signal S2 to the first output signal S1* and the second output signal S2* in a power-reduced coupling manner.

In some embodiments, the directional couplers C11, C12, C21 and C22 may be configured as four-port directional couplers (e.g., −10 dB coupler) having equivalent characteristics, where R11, R12, R21, R22 can be 50 ohms. In such power coupling circuits PD, if the directional couplers C11, C12, C21 and C22 are equivalent −10 dB couplers, then coupler C11 will pass 90% of the energy associated with the first input signal S1 to the input end of the coupler C12 and couple 10% of the energy associated with the first input signal S1 to coupler C22, where 90% of the coupled 10% signal will pass through termination resistor R22 to ground (and lost) and 10% of the coupled 10% signal (i.e., 1%=0.01, or −20 dB) will be provided to the output end of C22 (as a signal component of S2*). Likewise, coupler C21 will pass 90% of the energy associated with the second input signal S2 to the input end of coupler C22 and couple 10% of the energy associated with the second input signal S2 to coupler C12, where 90% of the coupled 10% signal will pass through termination resistor R12 to ground (and lost) and 10% of the coupled 10% signal (i.e., 1%) will be provided to the output end of C12 (as a component of S1*). In a similar manner, 90% of the 90% S1 signal received at the input end of coupler C12 will be passed as "(0.81)S1", the primary energy component of S1*, and 90% of the 90% S2 signal received at the input end of coupler C22 will be passed as "(0.81)S2", the primary energy component of S2*. In this case, S1*=(0.81)S1+(0.01)S2; S2*=(0.81)S2+(0.01)S1.

By the aforementioned power-reduced coupling manner, the power coupling circuit PD can effectively narrow the beam width of the antenna. Further, the power coupling circuit PD can narrow the beam width of the antenna at a fine degree. Of course, k1 to k4 may be adjusted as actually required.

In some embodiments, the first sub-component of the first RF signal assigned to the first radiating element 13 may occupy the largest share of the first RF signal. Likewise, the first sub-component of the second RF signal assigned to the second radiating element 15 may occupy the largest share of the second RF signal. That is, the radiating elements assigned with the power coupling circuit PD can be assigned with the largest share of sub-components of the RF signal. This is advantageous when a limited number of power coupling circuits PD, such as only one power coupling circuit PD, are provided in the antenna assembly, because a limited number of the power coupling circuits PD are able to narrow the beam width up to requirement standards and a reduction in number of the power coupling circuits PD may also reduce the manufacturing costs of the antenna.

FIG. 4 is a simplified schematic view of the antenna assembly 10 of FIG. 2. As shown in FIG. 4, the first radiating element 13 may be placed adjacent to the third radiating element 23 in a horizontal direction H. The first radiating element 13 may be disposed in a middle region of the first array A1, and the third radiating element 23 may be disposed in a middle region of the second array A2. In the embodiment as shown in FIG. 4, only one power coupling circuit PD, indicated by a dotted frame, is exemplarily shown, which is assigned to the first radiating element 13 and the third radiating element 23. In other embodiments, a plurality of, such as two, three, four or more power coupling circuits PD, may be assigned to the first array A1 and the second array A2 as required. Correspondingly, a plurality of first radiating elements 13 and a plurality of third radiating elements 23 may be provided in the first array A1 and the second array A2, respectively.

Referring to FIGS. 2 and 4, the first array A1 may further include a second radiating element 15 and fifth radiating elements 11, 12, 14, and the second array A2 may further include a fourth radiating element 25 and sixth radiating elements 21, 22, 24. The second radiating element 15 may be placed adjacent to the fourth radiating element 25 in a horizontal direction H. The second radiating element 15 may be placed in an end region, such as at an end, of the first array A1, and the fourth radiating element 25 may be placed in an end region, such as at an end, of the second array A2.

In the first array A1, most of the radiating elements, i.e. the first radiating element and the fifth radiating elements 11, 12, 14 may all be electrically connected to the first interface 2 via corresponding power distribution networks and/or phase shift networks, whereas the second radiating element 15 may be electrically connected to the second interface 3 via a corresponding power distribution network and/or phase shift network so that the second radiating element 15 is able to receive a second sub-component of the second RF signal from the second interface 3. In the second array A2, most of the radiating elements, i.e., the second radiating element and the sixth radiating element 21, 22, 24 may all be electrically connected to the second interface 3 via corresponding power distribution networks and/or phase shift networks, whereas the fourth radiating element 25 may be electrically connected to the first interface 2 via a corresponding power distribution network and/or phase shift network so that the fourth radiating element 25 is able to receive a second sub-component of the first RF signal from the first interface 2. The feeding mode of the second radiating element 15 and the fourth radiating element 25 may be called "staggered feeding".

Compared with the power coupling circuit PD, the staggered feeding is more cost-effective, but it narrows the beam width of the antenna in a rougher manner. Thus, in some cases, the mere use of the staggered feeding cannot narrow the beam width up to requirement standards, since the beam width may be narrowed excessively or insufficiently. Therefore, in the present invention, the beam width of the base station antenna is narrowed by appropriate combination of the power coupling circuit PD and the staggered feeding. In this way, the beam width, such as a −3 dB bandwidth and/or a −10 dB bandwidth, of the base station antenna 20 can be effectively narrowed in a cost-effective manner.

Figure 5:
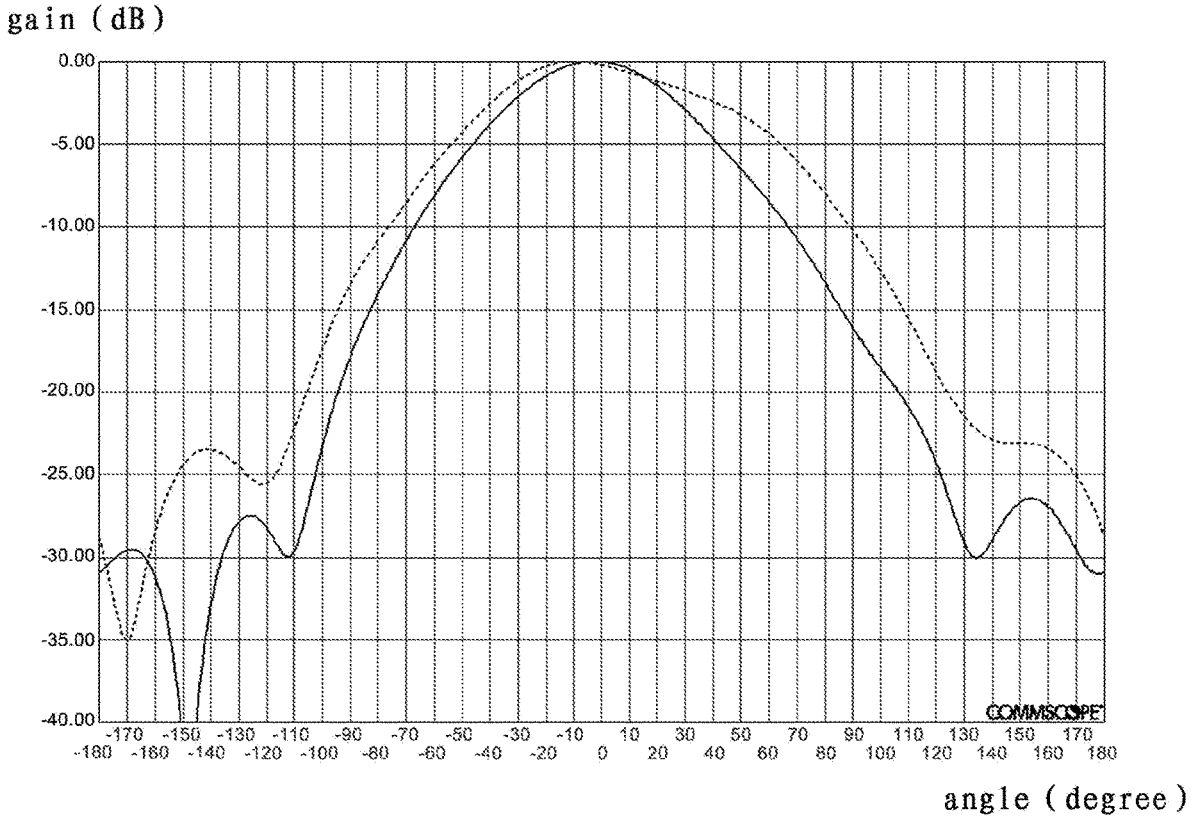
FIG. 5 is a graph showing a distribution of an azimuth beam width of the base station antenna of FIG. 2.

FIG. 5 is a graph showing distribution of an azimuth beam width of the base station antenna 20 of FIG. 2. The dotted curve shows the distribution of an azimuth beam width with the mere use of the staggered feeding, while the solid curve shows the distribution of an azimuth beam width when both the power coupling circuit PD and staggered feeding are used. As can be clearly seen from FIG. 5, by using both the power coupling circuit PD and staggered feeding, the azimuth HPBW, i.e., the −3 dB bandwidth, of the base station antenna 20, is within a satisfactory value range (for example, at about 65 degrees) in the operating frequency band. Further, the −10 dB bandwidth of the base station antenna 20 may be effectively narrowed, which can improve the sector power ratio of the antenna and thus improve the antenna gain.

Figure 6:
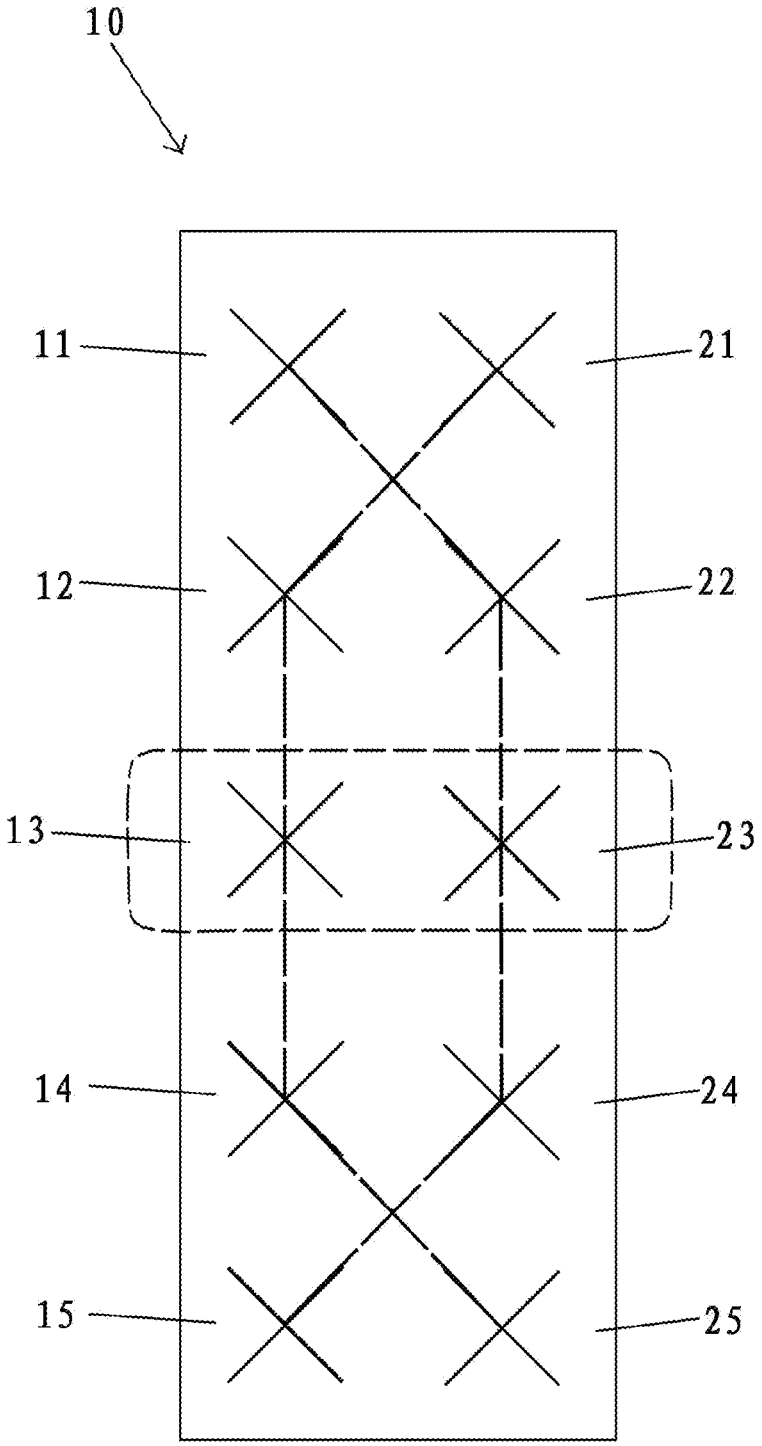
FIG. 6 is a simplified schematic view of an antenna assembly according to a second embodiment of the present invention.

FIG. 6 is a schematic view of an antenna assembly 10 according to a second embodiment of the present invention. Unlike the first embodiment shown in FIGS. 2 and 4, the antenna assembly 10 in FIG. 6 is provided with two second radiating elements 11 and 15 and two fourth radiating elements 21 and 25. The two second radiating elements 11 and 15 are both electrically connected to the second interface 3, wherein a first second radiating element 15 is placed in a first end region of the first array A1, and a second radiating element 11 is placed in a second end region of the first array A1. The two fourth radiating elements 21 and 25 are both electrically connected to the first interface 2, wherein a first fourth radiating element 25 is placed in a first end region of the second array A2, and a second fourth radiating element 21 is placed in a second end region of the second array A2. In this way, the beam width of the antenna can be further narrowed.

Figure 7:
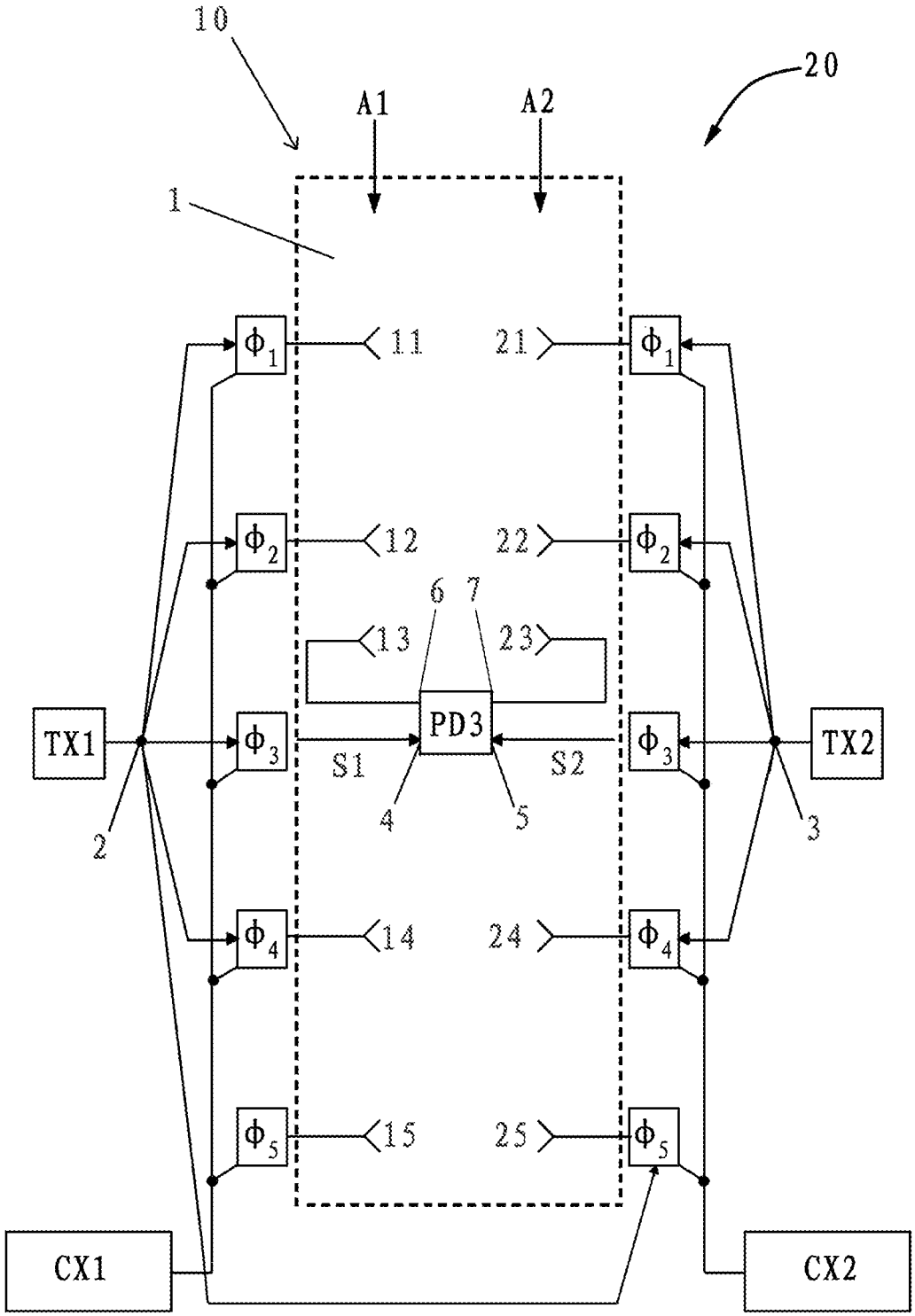
FIG. 7 is a schematic circuit block diagram of a base station antenna including an antenna assembly according to a third embodiment of the present invention.
Figure 8:
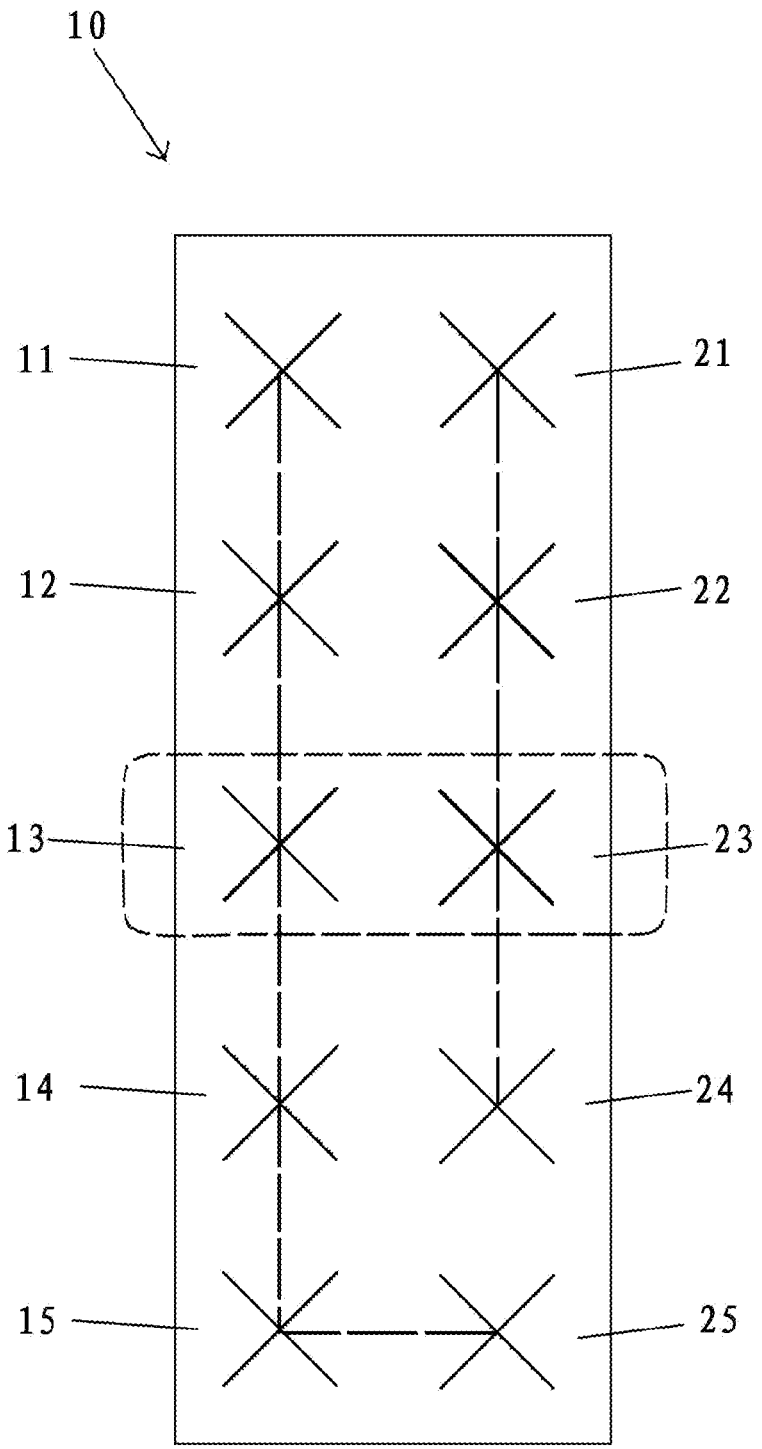
FIG. 8 is a simplified schematic view of the antenna assembly of FIG. 7.

FIG. 7 is a schematic view of a base station antenna 20 including an antenna assembly 10 according to a third embodiment of the present invention. Unlike the first embodiment shown in FIGS. 2 and 4, in the antenna assembly 10 of the base station antenna 20 shown in FIG. 7, the second radiating element 15 and the fourth radiating element 25 are both electrically connected to the first interface 2. Herein, both the second radiating element 15 and the fourth radiating element 25 may be electrically connected to the first interface 2 via corresponding power distribution networks and/or phase shift networks, so that the second radiating element 15 is able to receive a second sub-component of the first RF signal from the first interface 2, and the fourth radiating element 25 is able to receive a third sub-component of the first RF signal from the first interface 2. FIG. 8 is a block diagram of the antenna assembly 10 of FIG. 7. As can be clearly seen from FIG. 8, the plurality of radiating elements 11-15 in the first array A1 and the fourth radiating element 25 in the second array A2 form an L-shaped topology. Similarly, it is also possible that both the second radiating element 15 and the fourth radiating element 25 are electrically connected to the second interface 3. Correspondingly, the plurality of radiating elements 21-25 in the second array A2 and the second radiating element 15 in the first array A1 may form an L-shaped topology. This can also effectively narrow the beam width, such as a −3 dB bandwidth, of the base station antenna 20 while maintaining a high antenna gain.

Figure 9:
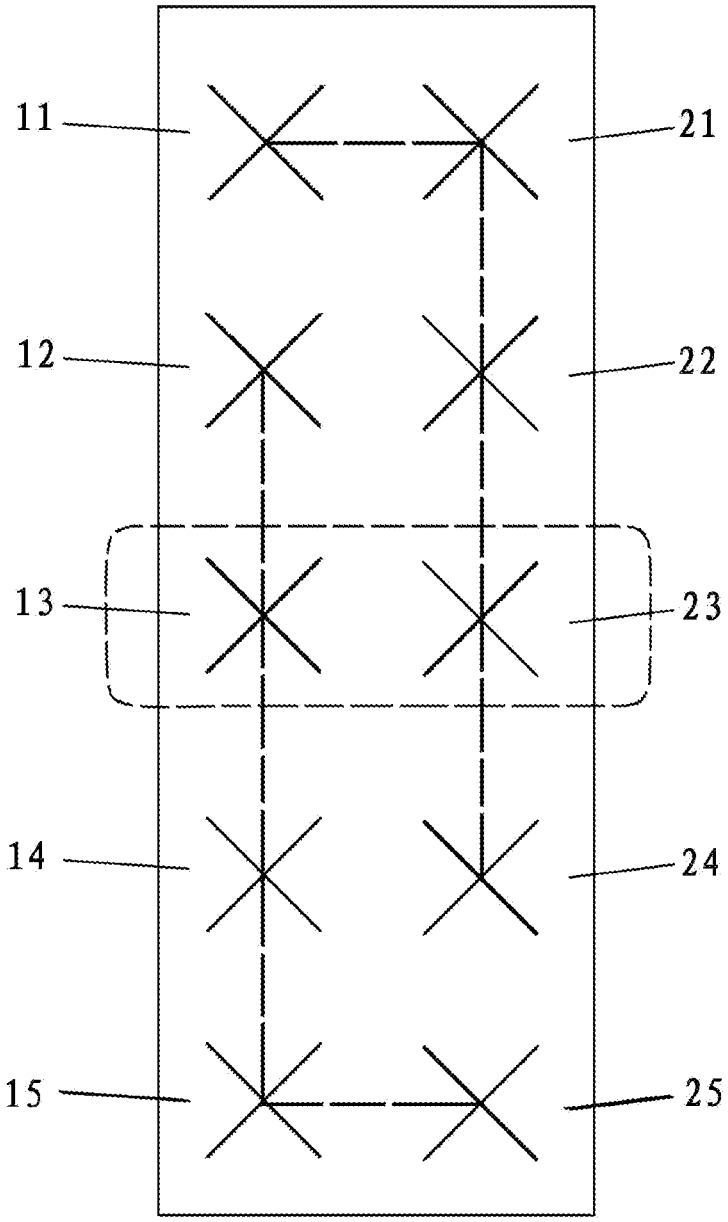
FIG. 9 is a simplified schematic view of an antenna assembly according to a fourth embodiment of the present invention.

FIG. 9 is a simplified schematic view of the antenna assembly 10 according to a fourth embodiment of the present invention. Unlike the third embodiment shown in FIG. 8, the antenna assembly 10 in FIG. 9 is provided with two second radiating elements 11, 15 and two fourth radiating elements 21, 25, wherein a first second radiating element 15 and a first fourth radiating element 25 are located in first end regions of the first array A1 and the second array A2 respectively, and are both electrically connected to the first interface 2, whereas a second radiating element 11 and a second fourth radiating element 21 are located in second end regions of the first array A1 and the second array A2 respectively and are electrically connected to the second interface 3. As can be clearly seen from FIG. 9, the plurality of radiating elements 12-15 in the first array A1 and the fourth radiating element 25 in the second array A2 form an L-shaped topology, and the plurality of radiating elements 21-24 in the second array A2 and the second radiating element 11 in the first array A1 form an L-shaped topology.

Figure 10:
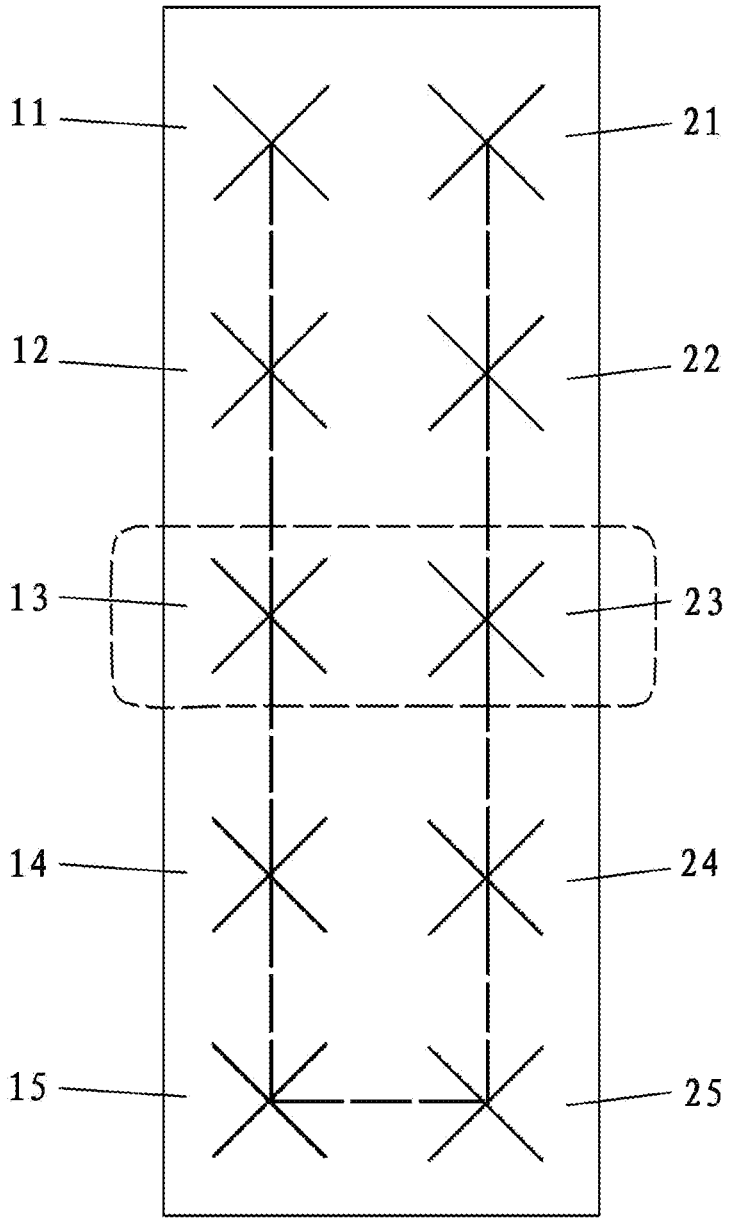
FIG. 10 is a simplified schematic view of an antenna assembly according to a fifth embodiment of the present invention.

FIG. 10 is a simplified schematic view of an antenna assembly 10 according to a fifth embodiment of the present invention. Unlike the third embodiment shown in FIG. 8, in the antenna assembly 10 of FIG. 10, the second radiating element 15 and the fourth radiating element 25 are electrically connected not only to the first interface 2 but also to the second interface 3. Herein, both the second radiating element 15 and the fourth radiating element 25 may be electrically connected not only to the first interface 2 but also to the second interface 3 via corresponding power distribution networks and/or phase shift networks, so that the second radiating element 15 is able to receive a second sub-component of the first RF signal from the first interface 2 and a second sub-component of the second RF signal from the second interface 3, and the fourth radiating element 25 is able to receive a third sub-component of the first RF signal from the first interface 2 and a third sub-component of the second RF signal from the second interface 3.

Figure 11:
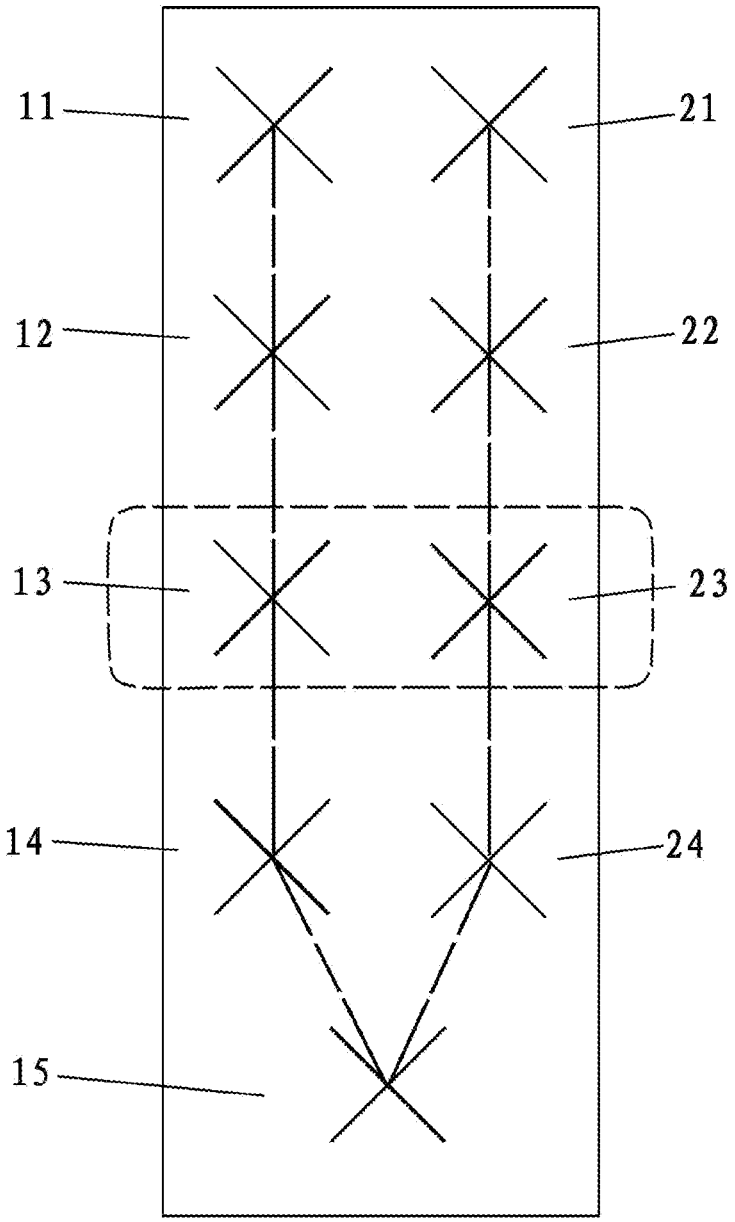
FIG. 11 is a simplified schematic view of an antenna assembly according to a sixth embodiment of the present invention.

FIG. 11 is a simplified schematic view of an antenna assembly 10 according to a sixth embodiment of the present invention. Unlike the third embodiment shown in FIG. 8, the antenna array in FIG. 11 includes, instead of the second radiating element 15 and the fourth radiating element 25, a seventh radiating element 16, which is in staggered arrangement from the first array A1 and the second array A2 in the horizontal direction H. The seventh radiating element 16 is electrically connected not only to the first interface 2 but also to the second interface 3. Herein, the seventh radiating element 16 may be electrically connected not only to the first interface 2 but also to the second interface 3 via a corresponding power distribution network and/or phase shift network, so that the seventh radiating element 16 is able to receive a second sub-component of the first RF signal from the first interface 2 and a second sub-component of the second RF signal from the second interface 3. As shown in FIG. 11, the seventh radiating element 16 is disposed near the first end regions of the first array A1 and the second array A2. However, it is also possible that the seventh radiating element 16 is disposed near the second end regions of the first array A1 and the second array A2, or another seventh radiating element is additionally disposed near the second ends of the first array A1 and the second array A2.

One or more of the following advantages can be provided by the antenna assembly according to the present invention by combined use of the staggered feeding and power coupling circuits PD: Firstly, the azimuth HPBW, that is, −3 dB bandwidth, of the antenna can be kept stable within the entire operating frequency band, for example, at about 65 degrees, such as at between 50 and 75 degrees. Secondly, the −10 dB bandwidth of the antenna can be effectively narrowed, thereby improving the sector power ratio of the antenna and thus the antenna gain. Thirdly, in the case where only one or a small number of power coupling circuits is needed, the energy loss of the antenna can be kept at a low level, and the manufacturing cost of the antenna can be well controlled. Fourthly, different working requirements of the base station antenna can be met by combined use of the staggered feeding and the power coupling circuits PD in the antenna assembly in a proper manner.

Although the exemplary embodiments of the present invention have been described, a person skilled in the art should understand that multiple changes and modifications may be made to the exemplary embodiments without substantively departing from the spirit and scope of the present invention. Accordingly, all the changes and modifications are encompassed within the protection scope of the present invention as defined by the claims.

What is claimed is:

1. An antenna assembly, comprising:

a first interface for receiving a first RF signal;

a second interface for receiving a second RF signal;

an antenna array including a first array having a first radiating element and a second radiating element therein, and a second array having a third radiating element and a fourth radiating element therein; and a power coupling circuit configured to feed a first sub-component of the first RF signal and a first sub-component of the second RF signal to the first radiating element and/or the third radiating element in a power-reduced coupling manner;

wherein a plurality of radiating elements in the first array are electrically connected to the first interface, and a plurality of radiating elements in the second array are electrically connected to the second interface, respectively; and wherein the second radiating element is electrically connected to the second interface, and/or the fourth radiating element is electrically connected to the first interface.

2. The antenna assembly according to claim 1, wherein the second radiating element and the fourth radiating element are electrically connected to either of the first interface and the second interface, respectively.

3. The antenna assembly according to claim 1, wherein the second radiating element and the fourth radiating element are electrically connected not only to the first interface but also to the second interface.

4. The antenna assembly according to claim 1, wherein the power coupling circuit includes a first input end, a second input end, a first output end, and a second output end; wherein the first input end is electrically connected to the first interface for receiving the first sub-component (S1) of the first RF signal, the second input end is electrically connected to the second interface for receiving the first sub-component (S2) of the second RF signal, the first output end is electrically connected to the first radiating element for feeding a first output signal (S1*) to the first radiating element, and the second output end is electrically connected to the third radiating element for feeding a second output signal (S2*) to the third radiating element.

5. The antenna assembly according to claim 4, wherein the first output signal (S1*) is generated from the first sub-component (S1) of the first RF signal and the first sub-component (S2) of the second RF signal in a power-reduced coupling manner as follows:

$$S1^*=(k1)S1+(k2)S2,$$

where k1 is a first power conversion coefficient, k2 is a second power conversion coefficient, and $0.7 \le k1 \le 0.90$; $0.005k2 \le 0.025$; and wherein the second output signal (S2*) is generated from the first sub-component (S2) of the second RF signal and the first sub-component (S1) of the first RF signal in a power-reduced coupling manner as follows:

$$S2^*=(k3)S2+(k4)S1,$$

where k3 is a third power conversion coefficient, k4 is a fourth power conversion coefficient, and $0.7 \le k3 \le 0.90$; $0.0026 \le k4 \le 0.027$.

6. The antenna assembly according to claim 1, wherein the antenna assembly includes a reflector, on which the antenna array is mounted, the reflector having a width that is not larger than 430 mm.

7. The antenna assembly according to claim 1, wherein the first array includes one or more fifth radiating elements that are electrically connected to the first interface, and/or the second array includes one or more sixth radiating elements that are electrically connected to the second interface.

8. The antenna assembly according to claim 1, wherein the first radiating element and the third radiating element are adjacent each other in a horizontal direction.

9. The antenna assembly according to claim 1, wherein the first radiating element is disposed in a middle region of the first array, and the third radiating element is disposed in a middle region of the second array.

10. The antenna assembly according to claim 1, wherein the second radiating element and the fourth radiating element are adjacent each other in a horizontal direction.

11. The antenna assembly according to claim 1, wherein the second radiating element is disposed in an end region of the first array, and the fourth radiating element is disposed in an end region of the second array.

12. The antenna assembly according to claim 1, wherein only one power coupling circuit is provided for the first array and the second array.

13. The antenna assembly according to claim 1, wherein the first sub-component of the first RF signal occupies the largest share of the first RF signal, and/or the first sub-component of the second RF signal occupies the largest share of the second RF signal.

14. The antenna assembly according to claim 1, wherein a plurality of radiating elements in the first array and the fourth radiating element in the second array form an L-shaped topology, and/or a plurality of radiating elements in the second array and the second radiating element in the first array form an L-shaped topology.

15. The antenna assembly according to claim 1, wherein the antenna assembly includes power distribution networks and/or phase shift networks; and wherein the first interface and the second interface are electrically connected to corresponding radiating elements via the power distribution networks and/or the phase shift networks, respectively.

16. An antenna assembly, comprising:

a first interface for receiving a first RF signal;

a second interface for receiving a second RF signal;

a reflector and an antenna array mounted on the reflector, the antenna array including a first array, which includes a first radiating element and a second radiating element, and a second array, which includes a third radiating element and a fourth radiating element; and only one power coupling circuit is provided for the first array and the second array, wherein the power coupling circuit is configured to feed a first sub-component of the first RF signal and a first sub-component of the second RF signal to the first radiating element and/or the third radiating element in a power-reduced coupling manner;

wherein a plurality of radiating elements in the first array are electrically connected to the first interface, and a plurality of radiating elements in the second array are electrically connected to the second interface, respectively; and wherein the second radiating element is electrically connected to the second interface, and/or the fourth radiating element is electrically connected to the first interface.

17. The antenna assembly according to claim 16, wherein only one second radiating element in the first array is electrically connected to the second interface, and/or only one fourth radiating element in the second array is electrically connected to the first interface.

18. The antenna assembly according to claim 16, wherein the first radiating element and the third radiating element are adjacent each other in a horizontal direction.

19. The antenna assembly according to claim 16, wherein the first radiating element is disposed in a middle region of the first array, and the third radiating element is disposed in a middle region of the second array.

20. The antenna assembly according to claim 16, wherein the second radiating element and the fourth radiating element are adjacent each other in a horizontal direction.

21. The antenna assembly according to claim 16, wherein the second radiating element is disposed in an end region of the first array, and the fourth radiating element is disposed in an end region of the second array.

22. The antenna assembly according to claim 16, wherein the first sub-component of the first RF signal occupies the largest share of the first RF signal, and/or the first sub-component of the second RF signal occupies the largest share of the second RF signal.

23. The antenna assembly according to claim 16, wherein a plurality of radiating elements in the first array and the fourth radiating element in the second array form an L-shaped topology, and/or a plurality of radiating elements in the second array and the second radiating element in the first array form an L-shaped topology.

24. The antenna assembly according to claim 16, wherein the reflector has a width not larger than 430 mm.

25. The antenna assembly according to claim 16, wherein the reflector has a width not larger than 400 mm.

26. An antenna assembly, comprising:

a first interface for receiving a first RF signal;

a second interface for receiving a second RF signal;

an antenna array including a first array, which includes a first radiating element, and a second array, which includes a third radiating element;

a power coupling circuit configured to feed a first sub-component of the first RF signal and a first sub-component of the second RF signal to the first radiating element in the first array and/or the third radiating element in a power-reduced coupling manner; and wherein the antenna array further includes a seventh radiating element, the seventh radiating element being in staggered arrangement from the first array and the second array in a horizontal direction, and the seventh radiating element being electrically connected to both the first interface and to the second interface; and wherein a plurality of radiating elements in the first array are electrically connected to the first interface, and a plurality of radiating elements in the second array are electrically connected to the second interface.

27. The antenna assembly according to claim 26, wherein the first radiating element and the third radiating element are adjacent each other in the horizontal direction.

28. The antenna assembly according to claim 26, wherein the first radiating element is disposed in a middle region of the first array, and the third radiating element is disposed in a middle region of the second array.

29. The antenna assembly according to claim 26, wherein the seventh radiating element is disposed between the first array and the second array in the horizontal direction.

30. The antenna assembly according to claim 26, wherein the first sub-component of the first RF signal occupies the largest share of the first RF signal, and/or the first sub-component of the second RF signal occupies the largest share of the second RF signal.

* * * * *